United States Patent [19]

Kawashima et al.

[11] Patent Number: 4,791,448

[45] Date of Patent: Dec. 13, 1988

[54] HEAT ROLLER FIXING DEVICE FOR AN ELECTROPHOTOGRAPHIC PRINTING APPARATUS

[75] Inventors: Masato Kawashima; Kyohei Hashizume, both of Kawasaki, Japan

[73] Assignee: Fujitsu Limited, Kawasaki, Japan

[21] Appl. No.: 890,511

[22] Filed: Jul. 30, 1986

[30] Foreign Application Priority Data

Aug. 20, 1985 [JP] Japan ..... 60-182207
Oct. 19, 1985 [JP] Japan ..... 60-234086

[51] Int. Cl.[4] ..... G03G 15/20

[52] U.S. Cl. ..... 355/3 FU; 355/14 FU; 219/216

[58] Field of Search ..... 355/3 FU, 14 FU, 3 DR; 219/216, 469-471; 100/176

[56] References Cited

U.S. PATENT DOCUMENTS

| | | | |
|---|---|---|---|
| 3,916,256 | 10/1975 | Kotani | 219/216 X |
| 4,091,266 | 5/1978 | Ito et al. | 219/504 |
| 4,110,068 | 8/1978 | Brown et al. | 219/216 X |
| 4,145,181 | 3/1979 | Edwards et al. | 355/3 FU X |
| 4,147,501 | 4/1979 | Goshima et al. | 355/3 FU X |
| 4,464,985 | 8/1984 | Asanuma et al. | 100/176 X |
| 4,696,561 | 9/1987 | Katohi et al. | 355/3 FU |

FOREIGN PATENT DOCUMENTS

| | | | |
|---|---|---|---|
| 0213745A | 3/1987 | European Pat. Off. | 355/3 FU |
| 61-2942 | 1/1986 | Japan . | |
| 61-3005 | 1/1986 | Japan . | |
| 61-282872 | 12/1986 | Japan | 355/3 FU |

OTHER PUBLICATIONS

Examined Patent Publication (KOKOKU) No. 61-2942 (Unexamined Patent Publication—kokai—No. 55-135879)—Ricoh—.

Japanese Patent Application No. 60-17674 (Unexamined Patent Application—kokai—No. 61-176964).

European Search Report, Vienna, 10/31/86, Examiner: Schmidt.

*Primary Examiner*—A. C. Prescott
*Assistant Examiner*—Jane Lav
*Attorney, Agent, or Firm*—Staas & Halsey

[57] ABSTRACT

In a heat roller fixing device in a printing apparatus, a pressure roller and a heat roller are arranged in opposition to each other, and a medium is passed between the rollers to fix an image formed thereon. The device includes a heat roller unit in which the heat roller is supported by a fixing frame, and a main frame having guide rails for the heat roller unit, and the heat roller unit can be inserted in and withdrawn from the main frame along the guide rails.

8 Claims, 12 Drawing Sheets

HEAT ROLLER FIXING DEVICE FOR AN ELECTROPHOTOGRAPHIC PRINTING APPARATUS

FIELD OF THE INVENTION

The present invention relates to a heat roller fixing device used in a printing apparatus which performs development for printing after forming an electrophotographic or electrostatic latent image and, more particularly, to a heat roller fixing device which allows easy mounting and demounting of a heat roller unit.

Printing apparatuses (e.g., a copy machine, a recording apparatus, and the like) utilizing an electrophotographic technique or an electrostatic recording technique have been widely used. In such an electrophotographic printing apparatus, a latent image is formed and is converted to a visible image using a developer (which normally adopts a developing agent powder). Thereafter, the powder image (toner image) is fixed using a fixing device.

In this electrophotographic apparatus, a heat roller fixing device having a simple structure is adopted, and the heat roller fixing device of this type has a long life, is fixed to the apparatus, and cannot be easily removed therefrom.

Namely, in the conventional apparatus, the service life of the heat roller corresponds to 100,000 sheets or more, and the halogen lamp (heat source) incorporated therein also has a long life. When the service life of the heat roller fixing device ends, it is considered that the life of the apparatus is also ended. Therefore, the fixing device is arranged so that it cannot be replaced.

However, as the service life of such an apparatus has been prolonged by advanced techniques, a demand has arisen for an arrangement allowing the replacement of the heat roller type fixing device and, more spcifically, the roller and halogen lamp of the heat roller. In the related art device, replacement and maintenance are difficult.

In the heat roller fixing device in which the fixing is carried out by the heat roller, the temperature of the heat roller is measured, and accordingly, the power source of the heater which is used as a heat source is controlled. In the detection of the temperature to lessen the temperature ripple, a thermistor having a small capacitance and a negative temperature characteristic is provided, namely, the resistance becomes small when the temperature rises.

Therefore, if an apparent resistance of the thermistor becomes large because of a failure of the thermistor, it is judged that the temperature of the heat roller is low, and the power supply to the heater source is continued, which causes a runaway overheating of the heater.

On the other hand, in the construction of the heat roller fixing device, the temperature detecting portion is connected via a connector to a main body, and the above-mentioned heat runaway overheating can be caused when the connector is disconnected. Accordingly, and desirably, supply of the power source for the heater by detecting a disconnection of the connector is prevented.

To detect a disconnection of a connector or a break down of a thermistor, conventionally a method is adopted whereby a variation of a resistance of the thermistor is detected during a predetermined constant period from the time when the power supply for the heater is commenced.

As explained above, the temperature detecting portion is connected to the main body, and this connection is often forgotten when the apparatus is mounted or when maintenance or testing is carried out. Confirming the connection is carried out by an indirect method, such as checking a variation of the resistance of the thermistor, and therefore, it is difficult to prevent runaway overheating, and thus operation of the heat fixing apparatus, becomes unreliable.

SUMMARY OF THE INVENTION

An object of the present invention is to provide a heat roller fixing device which allows easy mounting and demounting of a heat roller section. Another object of the present invention is to detect only the disconnection of the connector of the thermistor by a direct means and prevent the supply of the power source to the heater.

To achieve the above-mentioned objects, in the present application there is provided, a printing apparatus which includes an image forming means for forming a toner image, a feeding means for feeding a medium, a transferring means for transferring the toner image from the latent image forming means to the medium fed by the feeding means at an intermediate position along a medium feed path, and a heat roller fixing device in which a pressure roller and a heat roller are arranged in opposition to each other, and the medium is passed between the rollers to fix the image formed thereon. The present invention is characterized in that, the pressure roller is formed so as to move upward and downward; the heat roller fixing device comprises a heat roller unit, in which the heat roller is supported, and a main frame having guide rails for the heat roller unit, and the heat roller unit can be inserted and withdrawn from the main frame along the guide rails when the pressure roller is moved downward. The heat roller fixing device has a driving portion formed by gear construction; having chamfered gear portions, which driving portion is engaged with a driving gear provided in the main frame when the heat roller unit is inserted to the main frame, and an engaging member for fixing the heat roller fixing device inserted along the guide rails is mounted on the main frame.

Further, according to the present invention, the heat roller fixing device comprises a thermistor which detects a variation of a resistance value thereof and supplies a power source to a heater in the heat roller, and maintains the heat roller at a predetermined temperature. The heat roller fixing device comprises a connector which connects the thermistor and the main frame, and which includes a first terminal for supplying a current to the thermistor and a second terminal for supplying a current via a resistor in the main frame and a common terminal. A detector circuit detects an electric potential at the first and the second terminals, and the output of the first terminal controls the temperature of the heat roller. Thus, when the connector is disconnected, the supply of the power source is stopped by detecting the potential of the second terminal regardless of the potential of the first terminal.

Further features and advantages of the present invention will be apparent from the ensuing description with reference to the accompanying drawings to which, however, the scope of the invention is in no way limited.

DETAILED DESCRIPTION OF THE PREFERRED EMBODIMENTS

Figure 1:
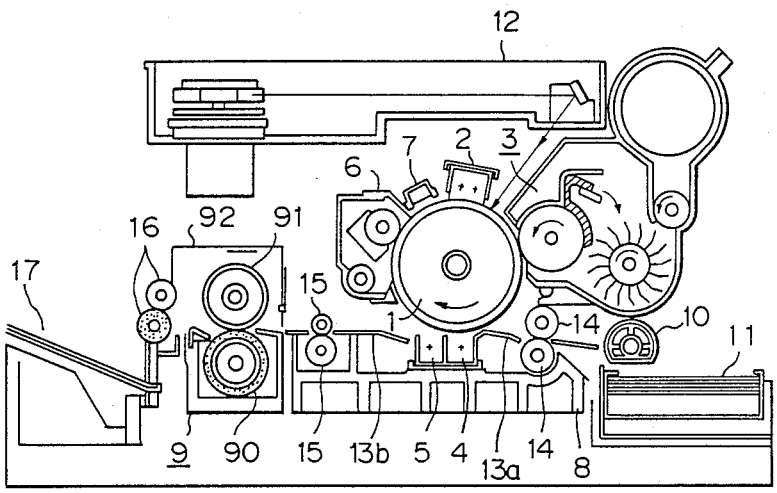
Fig. 1 PRIOR ART
FIG. 1 is a sectional view for explaining a conventional printing apparatus.

FIG. 1 is a sectional view for explaining a conventional apparatus. In a printing apparatus shown in FIG. 1, a charger 2, a developer 3, a transfer unit 4, a paper separation unit 5, a cleaner unit 6, and a discharger 7 are arranged around a photosensitive drum 1 having a photosensitive layer on the surface thereof. After the photosensitive drum 1, which is rotated clockwise, is uniformly charged by the charger 2, the photosensitive drum 1 is exposed by an optical image emitted from a optical unit (laser light source, or the like) through a reflection mirror to form a latent image corresponding to the optical image thereon, and the latent image is developed to be a visible image (toner image) by the magnetic brush type developer 3. A paper sheet picked up from a paper feed cassette 11 by a pickup roller 10 is guided to a lower guide 13a by standby rollers 14 in synchronism with the rotation of the photosensitive drum 1, and is then fed to the transfer unit 4. Next, the toner image formed on the photosensitive drum 1 is transferred to the paper sheet, and the paper sheet with the image is separated from the photosensitive drum 1 by means of an AC discharing of the paper separation unit 5. The paper sheet is guided along a lower guide 13b and is then fed to a heat roller fixing device 9 by feed rollers 15. After the image on the paper sheet is heated and fixed, the paper sheet is supplied to a stacker 17 by exhaust rollers 16. Meanwhile, the photosensitive drum 1 is cleaned by the cleaner unit 6 after the image formed thereon is transferred to the paper sheet, and the surface thereof is discharged by the discharger 7. Thereafter, the cycle beginning from the charger 2 is repeated.

In this printing apparatus, a heat roller fixing device 9 having a simple structure is adopted. The heat roller fixing device 9 includes a heat roller 91 having a halogen lamp as a heat source, a pressure roller 90, and a cover 92 for preventing heat leakage from the heat roller 91 outside the device 9. A paper sheet with a toner image is fed while the toner image surface thereof is urged against the heat roller 91 by the pressure roller 90, so that the toner image is heated and melted to be fixed. The heat roller fixing device of this type has a long life, is fixed to the apparatus, and cannot be easily removed therefrom.

In the conventional apparatus, the service life of the heat roller 91 corresponds to 100,000 sheets or more, and the halogen lamp (heat source) incorporated therein also has a long life. When the service life of the heat roller type fixing device 9 ends, it is considered that the life of the apparatus is also ended. Therefore, the fixing device is arranged so that it cannot be replaced.

Nevertheless, the service life of such an apparatus has been prolonged by advanced techniques, and accordingly, a demand has arisen for an arrangement allowing the replacement of the heat roller fixing device 9 and, more specifically, the roller and halogen lamp of the heat roller 91. In the related art device, replacement and maintenance are difficult.

Figure 2:
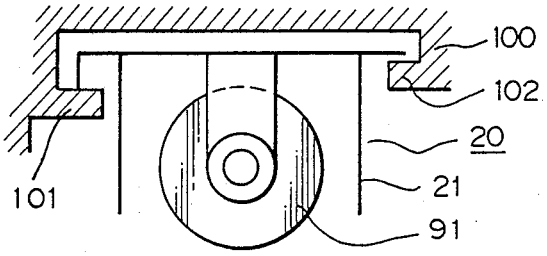
FIG. 2 is a diagram for explaining the principle of the printing apparatus according to the present invention.

FIG. 2, is a view for explaining the principle of the present invention.

Referring to FIG. 2, reference numeral 20 denotes a heat roller unit, in which a heat roller 91 is supported by a fixing frame 21; and 100 denotes a main frame, having guide rails 101 and 102 on both sides thereof, along which the fixing frame 21 is guided and supported.

Thus, according to the present invention, a heat roller is arranged in a heat roller unit, and guide rails 101 and 102 are provided to a main frame 100.

According to the present invention, since the heat roller 91 is supported and covered by the fixing frame 21 to be arranged in the heat roller unit 20, this allows easy handling. In addition, the heat roller 91 can be easily inserted in and withdrawn from the main frame 100 using the guide rails 101 and 102 during replacement or maintenance.

Figure 3:
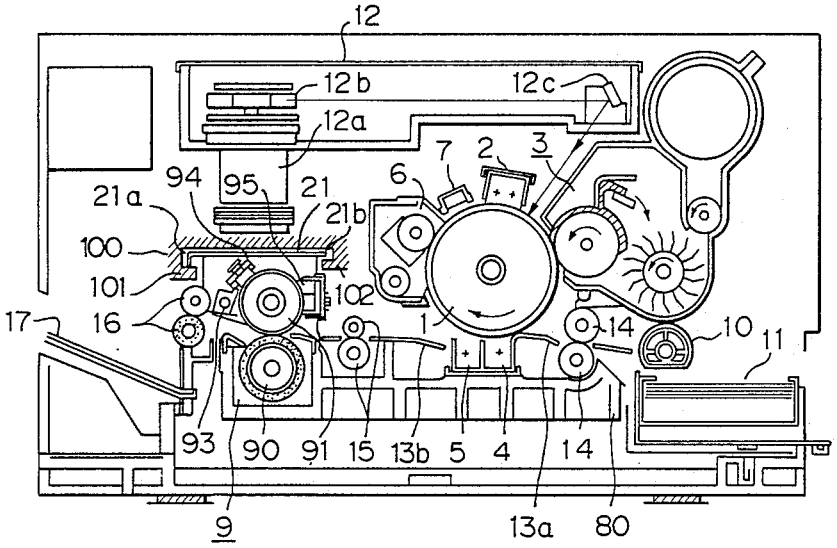
FIG. 3 is a sectional view of the overall arrangement according to one embodiment of the present invention.
Figure 4A:
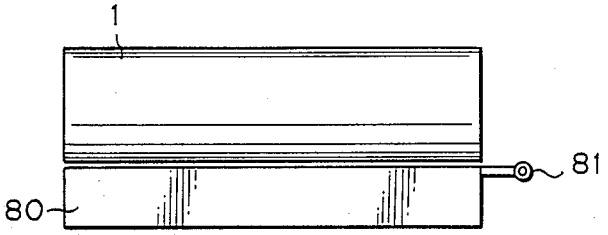
FIGS. 4A to 4C are views for explaining the operation of the overall arrangement according to the embodiment of the present invention.
Figure 4B:
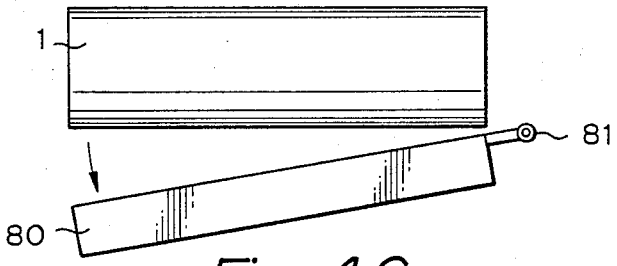
Figure 4C:
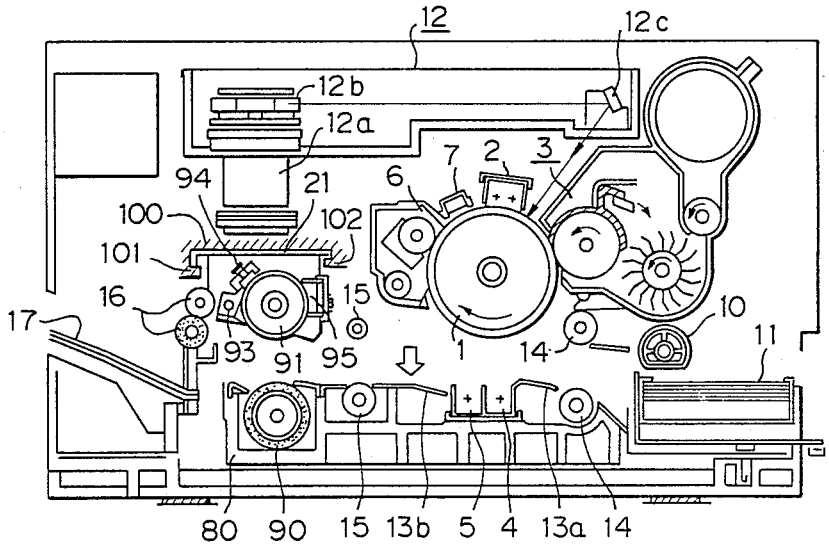

FIG. 3 shows the overall arrangement according to an embodiment of the present invention, and FIGS. 4A to 4C are views for explaining the operation thereof.

The same reference numerals in FIGS. 3 and 4A~4C denote the same parts as in FIGS. 1 and 2. Referring to FIGS. 3 and 4A~4C, reference numerals 21*a* and 21*b* denote engaging portions which are formed by extending the upper portion of a fixing frame 21, and are engaged with guide rails 101 and 102 of a main frame 100; 93, a separation pawl, of a fixing device 9, provided to the fixing frame 21, for separating a paper sheet from a heat roller 91; 94, a cleaner, provided to the fixing frame 21, for removing residual toner attached to the heat roller 91; and 95, a temperature detector, which includes a thermistor, and which is arranged on the fixing frame 21 to detect the temperature of the heat roller 91 and to control a halogen lamp inside the heat roller 91, thus making the heating temperature constant. Reference numeral 80 denotes a frame for holding a pressure roller 90 as well as standby rollers 14, lower guides 13*a* and 13*b*, a transfer unit 4, a paper separation unit 5, and feed rollers 15; and 81, a hinge (FIGS. 4A and 4B) which allows the frame 80 to be pivoted about a supporting shaft with respect to a photosensitive drum 1 as a latent image forming means. Note that reference numeral 12*a* denotes a spindle motor of an optical unit 12; 12*b*, a rotating polygonal mirror which is rotated by the spindle motor 12a to scan an optical image emitted from a laser light source (not shown); and 12*c*, a reflection mirror for reflecting the optical image reflected by the polygonal mirror 12*b* to guide it to the photosensitive drum 1.

With the arrangement shown in FIGS. 3 and 4A~4C, since the pressure roller 90 is provided to the frame 80 of the convey system and the frame 80 is pivotal about the hinge 81, as shown in FIG. 4B, the pressure roller 90 can be vertically moved integrally with the paper conveyer system with respect to the photosensitive drum 1.

Therefore, when the frame 80 is pivoted about the hinge 81, as shown in FIG. 4C, the pressure roller 90 of the fixing device 9 is also moved downward together with the paper conveyer system and is separated from the heat roller 91, thereby opening a paper conveying path to the fixing device 9. All of the paper conveying paths are opened by a single operation during a paper jam or maintenance, thus allowing easy replacement of the pressure roller 90 as well as easy removal of a jamming paper sheet, and allowing easy maintenance.

Since the pressure roller 90 can be moved downward by the frame 80 as described above, the heat roller 91 is released from the pressure force of the pressure roller 90. For this reason, the heat roller unit 20 can be easily inserted in and withdrawn from the main frame 100. More specifically, the heat roller unit 20 can be individually handled, and can be easily mounted or removed from the frame.

Figure 5A:
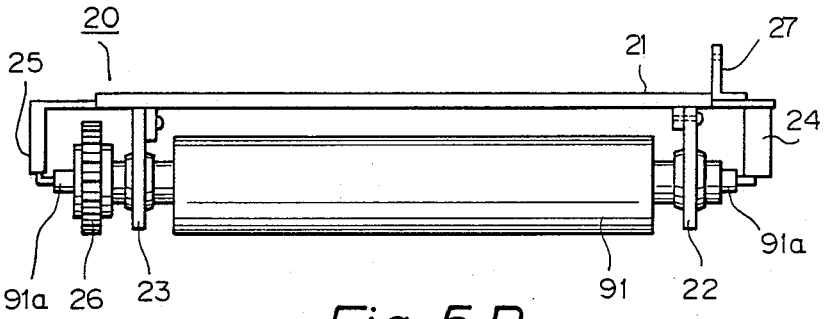
FIGS. 5A to 5D are views of the arrangement of a heat roller unit according to the embodiment of the present invention.
Figure 5B:
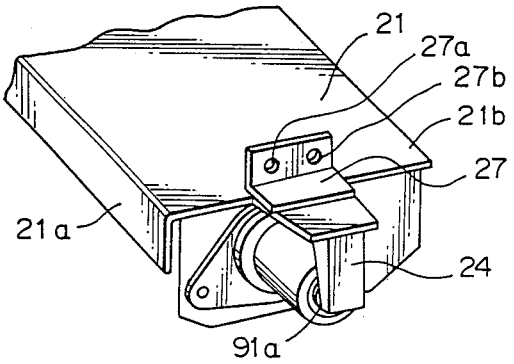
Figure 5C:
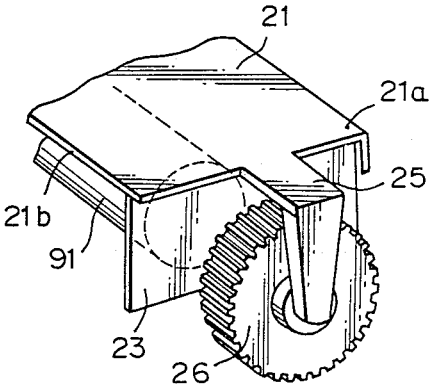
Figure 5D:
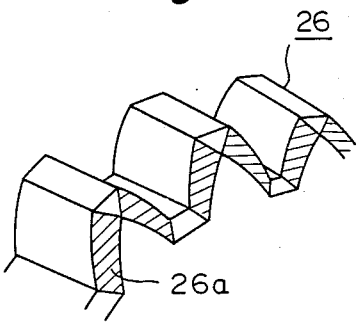

FIGS. 5A~5D show the heat roller unit according to the embodiment of the present invention, in which FIG. 5A is a side view thereof; FIG. 5B is a perspective view from the right in FIG. 5A; FIG. 5C is a perspective view from the left in FIG. 5A; and FIG. 5D is an enlarged view of a gear.

The same reference numerals in FIGS. 5A~5D denote the same parts as in FIGS. 2 to 4A~4C. Referring to FIGS. 5A~5D, reference numerals 22 and 23 denote support plates for holding roller shaft ends inside the heat roller 91 to support same; 24 and 25 are lamp holders for holding electrode portions at the distal ends of lamp sockets; 26, a gear, arranged on the lamp socket, for rotating the heat roller 91; 27, a mounting plate, arranged on the fixing frame 21 and having a screw hole 27*a* and an alignment hole 27*b*, for mounting the fixing frame 21 on the main frame 100; and 91*a*, a lamp socket for the electrodes of the halogen lamp inside the heat roller 91. Note that reference numeral 26*a* denotes chamfered gear portions, which allow easy engagement with a drive gear of the main frame 100 (to be described later).

The heat roller unit 20 pivotally supports the heat roller 91 using the support plates 22 and 23, the halogen lamp in the heat roller 91 can be electrically connected to an external circuit by the lamp holders 24 and 25, and the heat roller 91 can be rotated by the gear 26. In addition, the fixing frame 21 has the engaging portions 21*a* and 21*b* at the two ends thereof and at the mounting plate 27 to be mounted on the main frame 100. Note that, in the drawings, the separation pawl 93, the cleaner 94, the temperature detector 95 and the like are omitted.

Figure 6A:
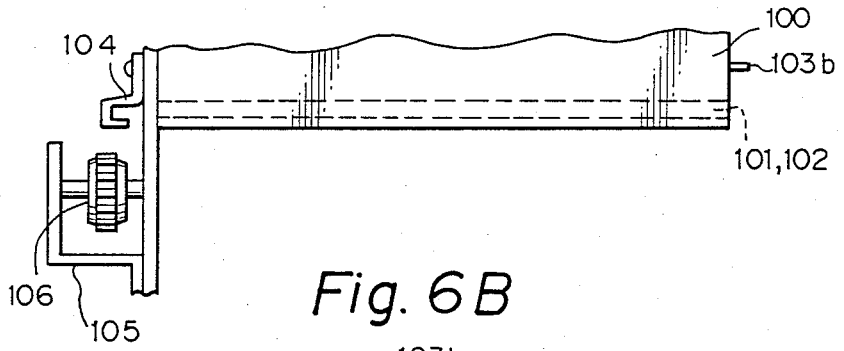
FIGS. 6A to 6C are views of the arrangement of a main frame according to the embodiment of the present invention.
Figure 6B:
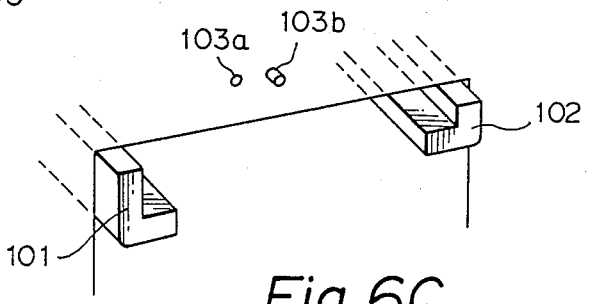
Figure 6C:
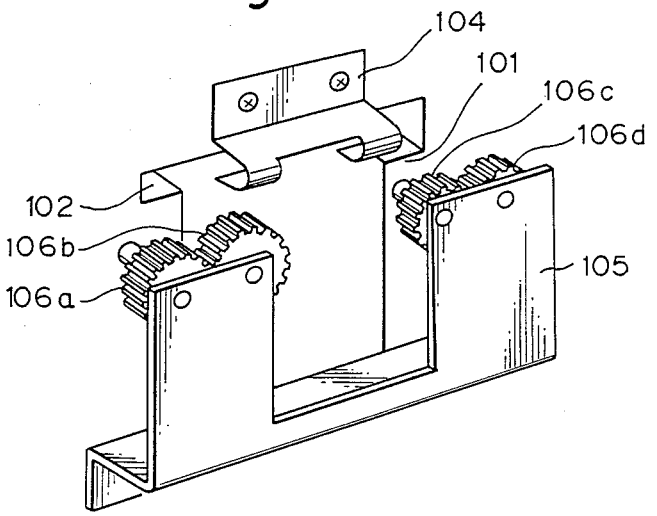

FIGS. 6A~6C show an arrangement of the main frame according to the embodiment of the present invention, in which FIG. 6A is a side view thereof; FIG. 6B is a perspective view from the right in FIG. 6A; and FIG. 6C is a perspective view from the left in FIG. 6A.

The same reference numerals in FIGS. 6A~6C denote the same parts as in FIGS. 2 to 4. Referring to FIGS. 6A~6C, reference numeral 103a denotes a screw hole corresponding to the screw hole 27*a* of the mounting plate 27; 103*b*, an alignment pin corresponding to the alignment hole 27*b* of the mounting plate 27; 104, an engaging member, mounted on the main frame 100, for engaging the fixing frame 21 inserted along the guide rails 101 and 102 so that the lamp holder 25 extends through an opening thereof; 105, a gear support member for supporting a drive gear; 106*a* and 106*b*, drive gears which receive a rotational force from a motor of the printing apparatus (not shown) and are engaged with and rotate the gear 26 of the heat roller 91 when the fixing frame 21 is mounted; and 106*c* and 106*d*, transmission gears which receive a rotational force through the drive gears 106*a* and 106*b*, and the gear 26 to rotate the exhaust roller 16 (FIG. 3) when the fixing frame 21 is mounted.

The main frame 100 has the guide rails 101 and 102 extending from the entrance (front end) to the rear portion thereof, and is provided with the alignment pin 103*b* (FIG. 6B) at the entrance, and with the engaging member 104 for the fixing frame 21 and the gears 106*a* to 106*d* engaged with the gear 26 at the rear portion.

Figure 7:
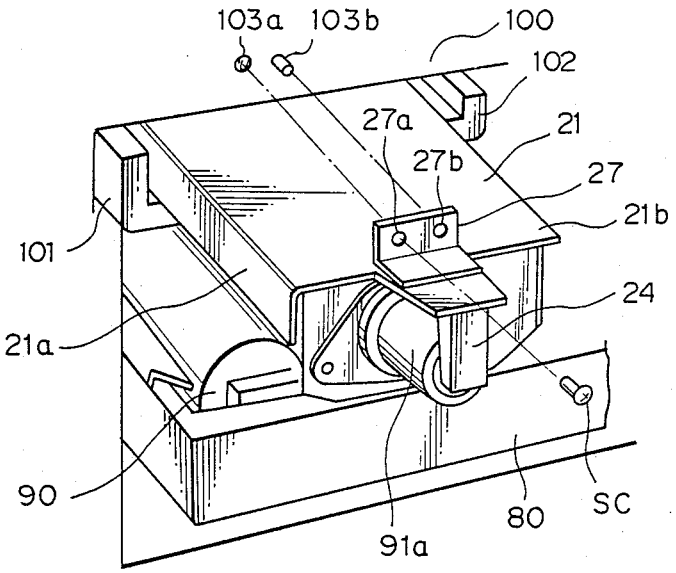
FIG. 7 is a perspective view for explaining an insertion state of the embodiment of the present invention.
Figure 8:
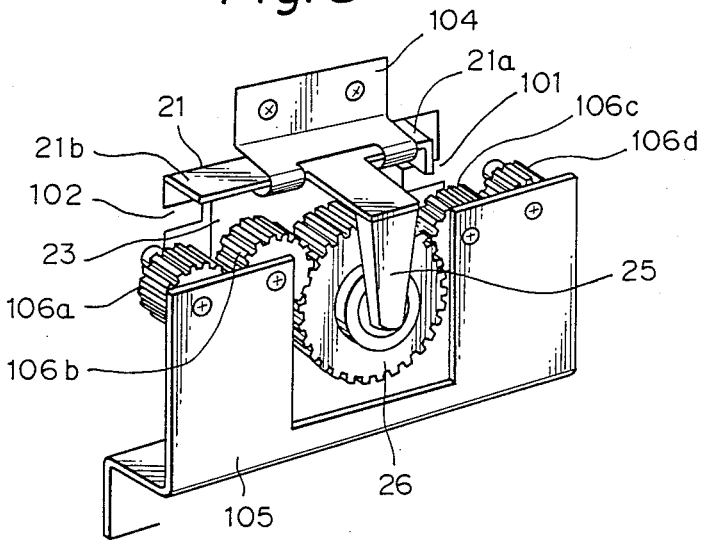
FIG. 8 is a perspective view for explaining a mounting state of the embodiment of the present invention.
Figure 9A:
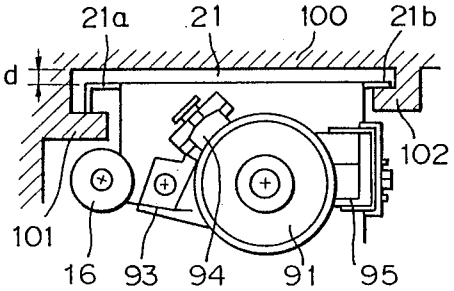
FIGS. 9A to 9F are views for explaining the insertion operation of the embodiment of the present invention.
Figure 9B:
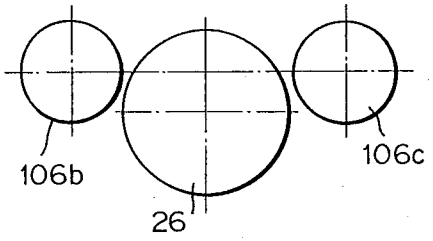
Figure 9C:
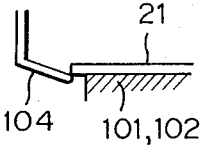
Figure 9D:
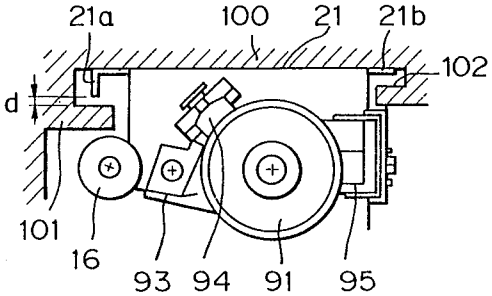
Figure 9E:
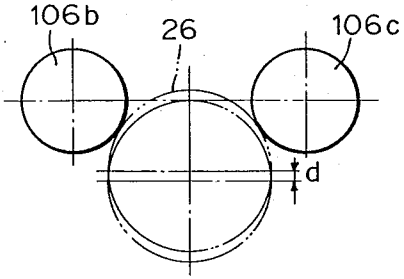
Figure 9F:
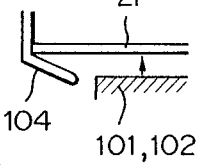
Figure 10:
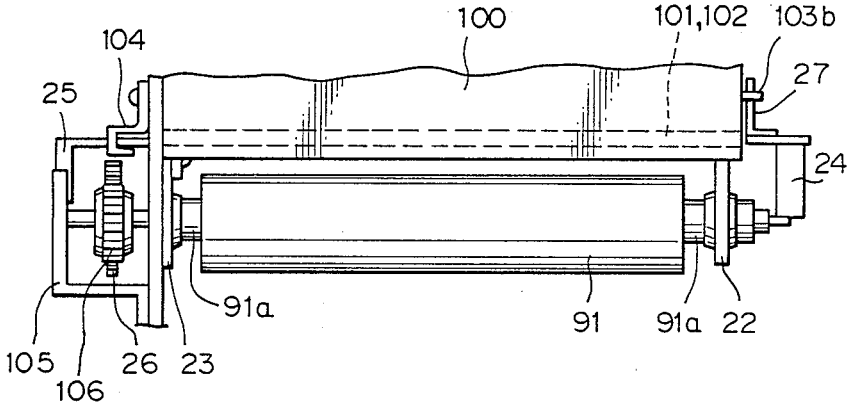
FIG. 10 is a side view of the mounting state of the embodiment of the present invention.

FIG. 7 is a perspective view showing the heat roller unit 20 inserted in the main frame 100, FIG. 8 is a perspective view of the rear portion of the main frame 100 when the heat roller unit 20 is inserted in the main frame 100, FIGS. 9A~9F are views for explaining the insertion operation of the heat roller unit 20 into the main frame 100, and FIG. 10 is a side view showing the heat roller unit 20 inserted in the main frame 100.

The heat roller unit 20 is inserted in the main frame 100 from the entrance thereof so that the engaging portions 21*a* and 21*b* of the fixing frame 21 are engaged with the guide rails 101 and 102, as shown in FIG. 7.

In this case, as shown in FIG. 9A, the heat roller unit 20 is inserted in the frame 100 to form a gap d therebetween, so that the engaging portions 21*a* and 21*b* are brought into contact with the guide rails 101 and 102. The positional relationship between the gear 26 of the fixing frame 21 and the gears 106*b* and 106*c* of the main frame 100 is as shown in FIG. 9B, so that a gap is formed therebetween.

When the heat roller unit 20 is inserted in the frame 100 along the guide rails 101 and 102, the distal end of the fixing frame 21 abuts against the engaging member 104 of the main frame 100, as shown in FIG. 9C.

When the heat roller unit 20 is further inserted, the fixing frame 21 is moved upward along the slope of the engaging member 104, as shown in FIG. 9F. Then, when the fixing frame 21 is completely mounted, the gap d is formed between the engaging portion 21*a* and 21*b* and the guide rails 101 and 102, as shown in FIG. 9D.

As shown in FIG. 9E, the gear 26 of the fixing frame 21 is moved upward toward the gears 106*b* and 106*c* of the main frame 100, and is smoothly meshed with the gears 106*b* and 106*c* upon operation of the chamfered gear portions 26*a* (FIG. 5D). The alignment pin 103*b* of the main frame 100 is inserted in the alignment hole 27*b* of the mounting plate 27 of the fixing frame 21, and a screw SC is screwed in the screw hole 103*a* of the main frame 100 through the screw hole 27*a*, thereby fixing the heat roller unit 20 to the main frame 100 through the mounting plate 27.

At this time, the distal end of the fixing frame 21 is engaged with the engaging member 104 of the main frame 100 at the rear portion of the main frame 100, and the gear 26 is engaged with the gears 106*b* and 106*c* as shown in FIG. 8. FIG. 10 is a side view of this state. In this way, the heat roller unit 20 is fixed to the main frame 100. Upon rotation of the gears 106*a* and 106*b*, the gear 26 is rotated and the heat roller 91 is also thereby rotated. In addition, the exhaust roller 16 is also rotated through the transmission gears 106*c* and 106*d*. The halogen lamp is powered through the lamp holders 24 and 25 by an electrical connection (not shown).

In order to remove the heat roller unit 20 from the main frame 100, the screw SC is loosened to disengage the mounting plate 27 from the main frame 100, and the heat roller unit 20 is then withdrawn from the main frame 100 along the guide rails 101 and 102.

As described above, the heat roller unit 20 including the heat roller 91 can be easily withdrawn from or inserted in the main frame 100.

In the above embodiment, the pressure roller 90 can be moved downward by the frame 80. Alternatively, the pressure roller 90 can be included in a unit, and the unit itself can be moved downward. In the above description, the heat roller unit 20 comprises the separation pawl 93, the cleaner 94, the temperature detector 95, and the exhaust roller 16, in addition to the heat roller 91. However, these can be omitted if not needed.

Figure 11A:
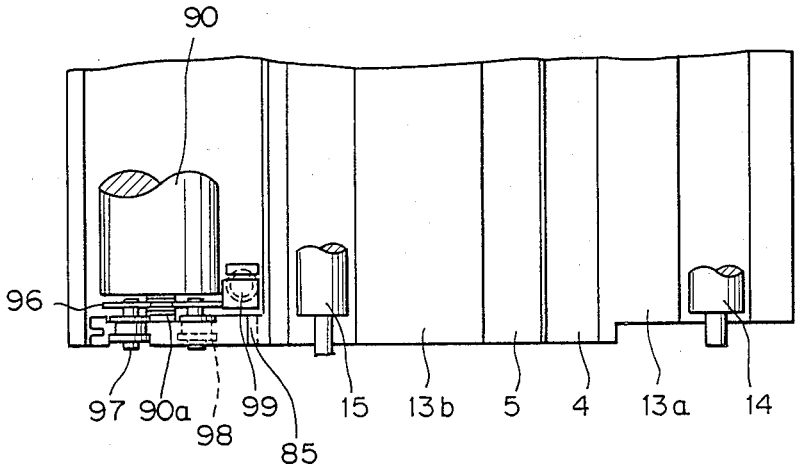
FIGS. 11A and 11B show the detailed structure of the frame in the embodiment of FIGS. 4A and 4B.
Figure 11B:
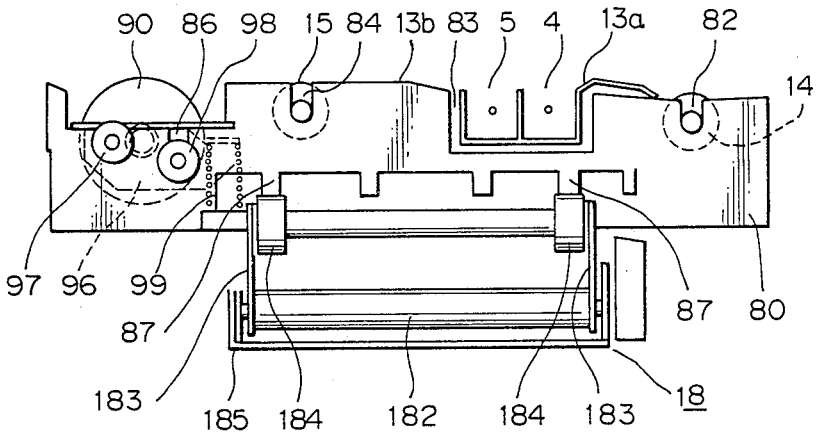
Figure 12:
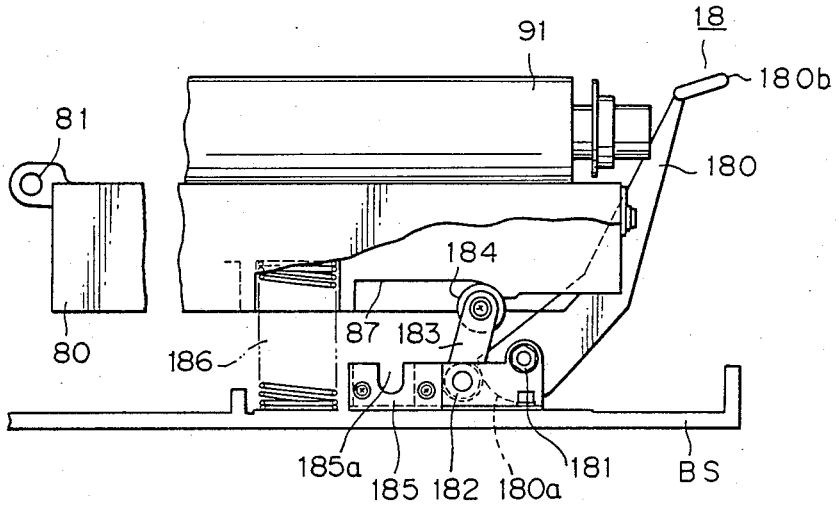
FIGS. 12 and 13 are a vertical drive mechanism of the frame shown in FIGS. 4A and 4B.

FIGS. 11A and 11B show the detailed structure of the frame 80 in the embodiment of FIGS. 4A and 4B, and FIG. 12 shows a vertical drive mechanism of the frame 80.

The same reference numerals as in FIGS. 1, 2, 4A, and 4B denote the same parts in FIGS. 11A, 11B, and 12. Reference numerals 82 and 84 denote roller support guides for respectively supporting wait and supply rollers 14 and 15 on the frame 80; 83, a compartment for allowing the frame 80 to accommodate the transfer unit 4 and the paper separator 5; 85, a spring support for mounting a compression spring for a pressure roller 90 on the frame 80; 86, a pressure guide for guiding a guide roller of the pressure roller to be described later; and 87, vertical drive guides mounted in the lower portion of the frame 80. The vertical drive guides 87 are adapted to selectively engage with guide rollers of the vertical drive mechanism. Reference numeral 96 denotes a pressure guide plate for supporting a shaft 90*a* of the pressure roller 90. The pressure guide plate 96 is pivotal about a support shaft (to be described below) disposed on the frame 80. Reference numeral 97 denotes a support shaft for pivotally supporting the pressure guide plate 96; and 98, a guide roller mounted on the pressure guide plate 96. The guide roller 98 is adapted to move along the pressure guide 86 of the frame 80 and to regulate pivotal movement of the guide plate 96. Reference numeral 99 denotes a compression spring arranged between the spring support 85 and the pressure guide plate 96 in the frame 80. The compression spring 99 biases the pressure guide plate 96 counterclockwise to cause it to pivot about the support shaft 97 so that the pressure roller 90 mounted on the pressure guide plate 96 is biased upward in FIG. 11B.

Reference numeral 18 denotes a vertical drive mechanism which causes the frame 80 to pivot about a hinge 81; and 180, an operation lever pivotal about a shaft 181. One end of the operation lever 180 has an operation bar 180*b* and the other end thereof constitutes a gear 180*a*. Reference numeral 182 denotes a gear; 183, a support lever; 184, a guide roller; and 185, a support block mounted on a base BS. The support block 185 supports the shaft 181 of the operation lever 180 and, at the same time, rotatably supports the gear 182. One end of each of the support levers 183 is engaged with the gear 182 and the other end thereof rotatably supports a corresponding one of the guide rollers 184. The gear 182 meshes with the gear 180*a* of the operation lever 180. Reference numeral 186 denotes a balance spring hooked between the base BS and the frame 80 to bias the frame 80 upward (FIG. 12).

The operation of the structure shown in FIGS. 11A to 12 will be described below.

As shown in FIGS. 11A and 11B, the pressure guide plate 96 is mounted on the frame 80 through the support shaft 97. The shaft 90*a* of the pressure roller 90 is supported by the pressure guide plate 96 which is formed by thermosetting resin, such as a polyester including a glass-fiber, and hence the frame 80 supports the pressure roller 90. That is, the pressure roller is supported by the plate having a relatively poor thermal transmission characteristic on the frame 80. As the pressure guide plate 96 is biased counterclockwise (FIG. 11B) by the compression spring 99, the pressure roller 90 is biased toward the heat roller 91 in the state shown in FIG. 12. The compression force of the pressure roller 90 normally falls within the range of 10 kg to 20 kg.

In the uppermost position of the operation lever, as shown in FIG. 12, the guide rollers 184 coupled to the support levers 183 are positioned using corresponding projections of the vertical drive guides 87 as stoppers. In this state, the frame 80 is kept in the position as shown in FIG. 3. In this state, normal printing operations such as paper feed and transfer can be performed.

Figure 13:
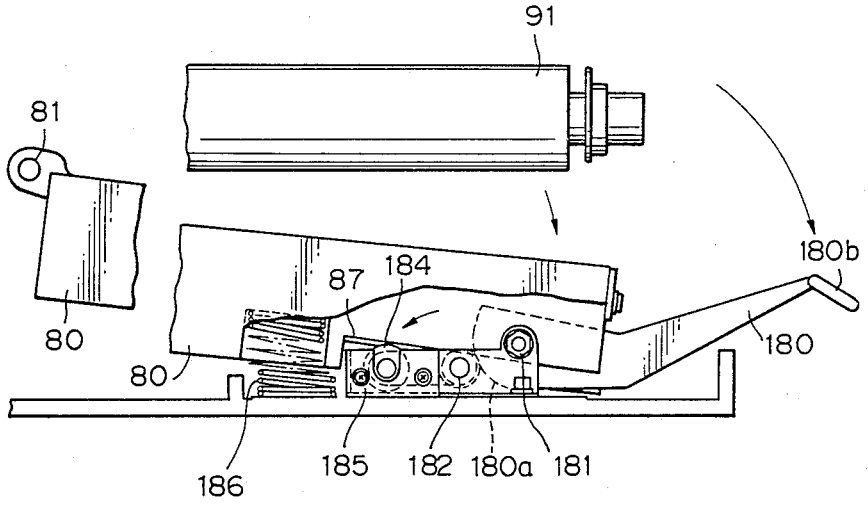

For maintenance and inspection, however, the operation lever 180 is pivoted clockwise about the shaft 181, as shown in FIG. 13. Since the gear 180*a* of the operation lever 180 meshes with the gear 182 coupled to the support levers 183, the support levers 183 are pivoted counterclockwise about the axis of the gear 182. The guide rollers 184 of the support levers 183 are moved downward upon pivotal movement of the support levers 183, and are received in and stopped by the compartment guide 185*a* of the support block 185. As the vertical guides 87 are selectively engaged with the guide rollers 184, the frame 80 is pivoted clockwise (FIG. 13) about the hinge 81 against the biasing force of the balance spring 186 by the weight of the frame 80. The frame 80 is then moved downward, as shown in FIG. 4C, to open the paper feed path. At this time, as the pressure roller 90 is disengaged from the heating roller 91, the pressure guide plate 96 is biased upward by the compression spring 99. However, the guide roller 98 abuts against the upper limit stopper of the pressure guide 86, and therefore, the upper position of the guide roller 98 is defined, and the guide roller 98 is not removed from the pressure guide 86.

In order to close the paper feed path and restore the state shown in FIG. 3, the operation lever 180 is pivoted counterclockwise about the shaft 181 from the state of FIG. 13. A meshing engagement between the gears 180a and 182 causes the support lever 183 to pivot clockwise, the guide rollers 184 are moved along the vertical drive guides 87 of the frame 80, and the frame 80 is pivoted counterclockwise about the hinge 81. Since the balance spring 186 biases the frame 80 counterclockwise, the operator can pivot the operation lever 180 with a slight force despite the weight of the frame 80. In the state shown in FIG. 12, wherein the guide rollers 184 of the support levers 183 abut against the projection stoppers of the vertical drive guides 87 of the frame 80, the angular positions of the support levers 183 and the operation lever 180 are defined, thereby restoring the state shown in FIG. 3.

As described above in detail, the paper feed path is open upon downward movement of the frame 80. The latent image forming mechanism including the optical unit 12 and the photosensitive drum 1 need not be shifted. The latent image forming mechanism may be vertically moved to open the paper feed path. However, in this case, the upper movable portion becomes undesirably heavy if a scanner or the like is mounted on the printing apparatus of the present invention to provide a copying function.

In the above embodiment, the frame 80 is vertically moved by pivoting. However, the frame 80 may be vertically moved by a mechanism for translating the frame 80 with respect to the base BS. In addition, if the optical unit 12 is replaced with the document scanner of a copying machine, the printing apparatus of the present invention can be used as a copying machine. Moreover, if the photosensitive drum 1 comprises an insulating drum and an electrostatic recording pin electrode is arranged, the printing apparatus of the present invention can be used as a transfer type electrostatic recording apparatus.

In a heat roller fixing apparatus in which the fixing is carried out by the heat roller, the temperature of the heat roller is measured, so that the power source of the heater which is used as a heat source is controlled. In the detection of the temperature, to lessen the temperature ripple, a thermistor having a small capacitance and a negative temperature characteristic is provided, i.e., the resistance becomes small when the temperature rises.

Therefore, if an apparent resistance of the thermistor is large because of a failure of the thermistor, then the temperature of the heat roller is judged to be low, and accordingly, the power supply to the heater source is continued which causes runaway overheating of the heater.

On the other hand, in the construction of the heat roller fixing apparatus, the temperature detecting portion 95 is connected via a connector to a main body, and the above-mentioned runaway overheating can occur when the connector is disconnected. Accordingly, and desirably, supply of the power source for the heater is prevented by detecting a disconnection of the connector.

The present invention detects the disconnection of the connector of the thermistor by a direct means and prevents the supply of the power source to the heater.

More particularly, as described below in regard to FIGS. 14 and 15, a connector means provides, in addition to a first terminal for supplying a current to the thermistor, a second terminal connected to the ground connecting terminal of the thermistor, and by adding a circuit for detecting electric potential at the second terminal, an abnormal heat runaway due to the disconnection of the thermistor or a non-attachment or disconnection of the connector can be prevented.

Figure 14:
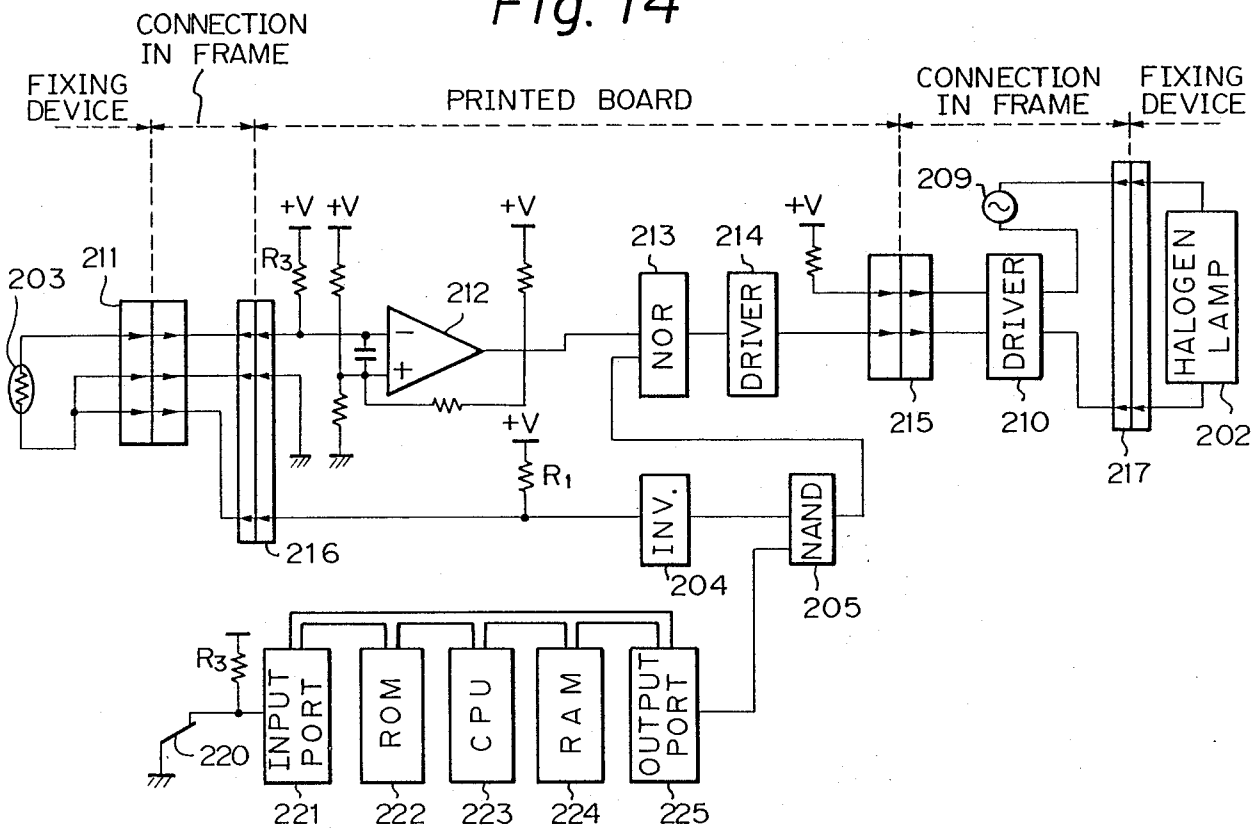
FIG. 14 is a block diagram of a circuit for detecting a disconnection of a heater; and, FIG. 15 is a block diagram of another circuit for detecting a disconnection of the heater.

FIG. 14 is a block diagram of the circuit of the present invention. In the circuit in FIG. 14, 202 is a halogen lamp, 203, a thermistor, 211 a connector for connecting the thermistor to a connection in a frame, 216 a connector for connecting the connection in the frame to a printed board, 212, an operational amplifier in which the output thereof is made "1" when the temperature at the thermistor 203 is higher than, for example, 180° C., i.e., the resistance of the thermistor 203 is low. 213 is a NOR gate, which operates as a detector circuit, 214 a driver which drives a driver 210 when the NOR circuit 213 outputs "1", and 215 a connector for connecting the driver 210 to the driver 214. Further, 204 is an inverter circuit, 205, an NAND circuit, 220, an operation switch 221, an input port, 222, a ROM, 223, a CPU, 224, a RAM, and 225, an output port.

In FIG. 14, the resistance of the thermistor 203 decreases when the temperature rises, the current supplied by a power source +V increases, a voltage drop due to a resistor $R_3$ increases, and a potential at a negative terminal of the operational amplifier 212 then falls. For example, a prescribed temperature of the heat roller 91 shown in FIG. 3 is assumed to be 180° C., accordingly, when the temperature is higher than this temperature, the operational amplifier 212 detects a potential at the negative terminal thereof and outputs "1", and outputs "0" when the temperature is lower than this temperature.

The power source voltage +V is also supplied via a resistor $R_1$ to the inverter circuit 204, and via the connector 211 and 216 to the ground. Therefore, the output of the inverter circuit 204 becomes "1" when the connectors 211, 216 release. Accordingly, when the output of the NAND circuit 205 becomes "0", the output of the NOR circuit 213 becomes 1 when the temperature is lower than 180° C., and then the driver 214 drives the driver 210 and the driver 210 supplies an alternate current source 209 to a halogen lamp 202.

When the temperature becomes higher than 180° C., the operational amplifier 212 outputs "1", and the NOR circuit 213 then outputs "0", so that the driver 214 stops the drive of the driver 210.

When the heat fixing apparatus is operated in a condition where the connector 211 is disconnected, "0" is supplied to the NAND circuit 205, and thus, when the operational amplifier 212 sends a logic value of either "1" or "0", the output of the NOR circuit 213 remains "0", regardless of the output of the operational amplifier 212.

Therefore, the driver 214 does not drive the driver 210, and accordingly, the halogen lamp does not become overheated and a runaway overheating is prevented.

The circuit formed by the elements 220, 221, . . . , 225 is provided for supplying the halogen lamp enable signal to the NAND gate 205. The switch 220 is a cover open switch, the input port 221 receives the output of the switch 220. The computer 223 includes the ROM 222 for controlling the switches and the RAM 224 having a flag required when the control is carried out. The output port 225 outputs a signal which enables the halogen lamp ON.

When the switch 220 is made ON while the cover is closed, the computer 223 searches the input port 21 according to the program of the ROM 222, and then outputs a signal from the output port 225 to the NAND circuit 205 so as to make impossible the drive of the halogen lamp.

Figure 15:
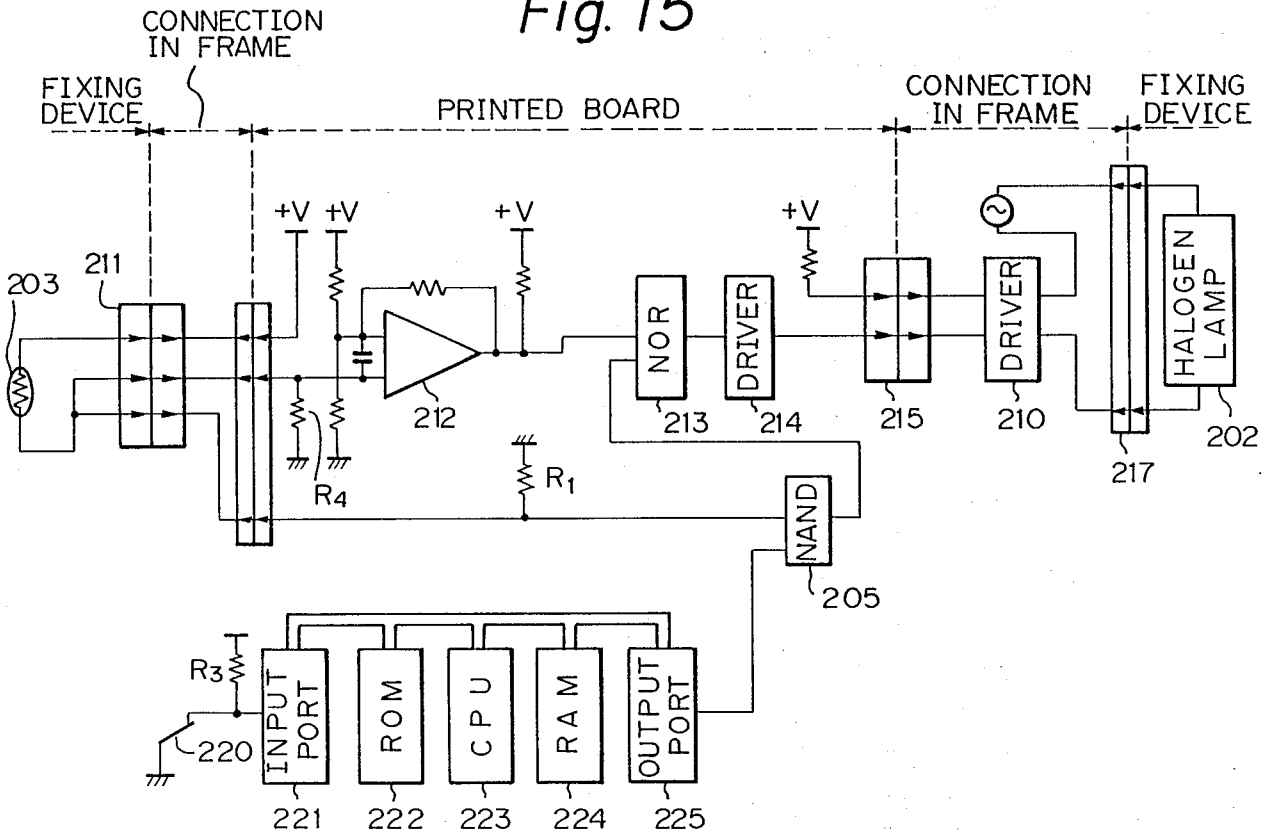

FIG. 15 is a block diagram of a circuit showing another embodiment of the present invention.

In FIG. 15, a method of detecting the variation of the resistance value of the thermistor 203 is different from that of FIG. 14, namely, a NOT circuit 204 in FIG. 14 is omitted so that the logic value "1" is supplied directly to the NAND circuit 205.

When the resistance of the thermistor 203 decreases, the voltage generated at the resistor $R_4$ increases. The operational amplifier 212 detects a potential at a positive terminal thereof, and sends "1" when the temperature rises higher than 180° C. When the NAND circuit 205 sends "0", and when the operational circuit 212 sends "0", the NOR circuit 213 sends "1" and the driver 214 drives the driver 210.

When the connector 211 is disconnected, "0" is supplied to the NAND circuit and the ouput of the NOR circuit 213 becomes "0", regardless of the logic value sent by the operational circuit 212.

According to the present invention as described above, a heat roller unit is arranged in a unit so as to be easily handled, and the main frame is provided with guide rails. Therefore, the heat roller unit can be easily inserted in or withdrawn from the main frame, thus allowing easy replacement and maintenance of the heat roller and the halogen lamp. In addition, the other components (e.g., a separation pawl) provided in the heat roller unit can also be replaced and maintained.

Since the heat roller unit can be removed during a paper jam, a jamming paper sheet can be easily removed. The service life of a conventional printing apparatus is determined by that of a heat roller type fixing device, but since the heat roller is arranged in a unit in the present invention, the fixing device can be treated as expendable, thus greatly prolonging the life of the printing apparatus.

Further, according to the present invention as described above, there is provided a printing apparatus comprising latent image forming means for forming a toner image, feeding means for feeding a medium, transferring means for transferring the toner image from the latent image forming means to the medium fed by the feeding means at an intermediate position along a medium feed path, and a heat roller fixing unit for fixing the toner image transferred to the medium, characterized in that the feeding means, the transferring means, and a pressure roller of the heat roller fixing unit are mounted on a frame, and vertical drive means for driving the frame vertically with respect to the latent image forming means is provided, thereby moving the frame downward by the vertical drive means to open the medium feed path. The medium feed path including the fixing unit can be opened by a single operation. Checking for paper jam and replacement and maintenance of the pressure roller can therefore be simplified. In addition, the pressure roller is mounted in the frame to constitute part of the paper feed mechanism. A special frame constitution is not required for the pressure roller, thus decreasing the number of parts thereof and reducing the cost. Furthermore, since the fixing unit cannot be withdrawn outside the apparatus, there is no fear of endangering the operator, thus providing a good practical effect.

Further, in the present invention, when the connector for connecting the thermistor is disconnected, the power source for the halogen lamp is stopped, and thus runaway overheating at the heater can be prevented.

We claim:

1. A printing apparatus, comprising:

(a) means for forming a toner image:

(b) means for feeding a medium, (c) means for transferring the toner image to the medium fed by said feeding means at an intermediate position along a medium feed path;

(d) a pressure roller which is formed so as to move upward and downward; and (e) a heat roller fixing unit, in which the pressure roller and a heat roller are arranged in opposition to each other, and said medium is passed between said rollers to fix said image formed thereon, said heat roller fixing unit including (i) a heat roller unit in which said heat roller is supported, (ii) a main frame having guide rails for said heat roller unit, wherein said heat roller unit can be separately inserted into and withdrawn from said main frame along said guide rails separate from said pressure roller when said pressure roller is moved downward, and (iii) a driving portion formed by a gear construction having gear portions to be engaged with a driving gear provided in said main frame, wherein said driving portion is engaged with said driving gear provided in said main frame when said heat roller unit is inserted into said main frame.

2. A printing apparatus, comprising:

(a) means for forming a toner image;

(b) means for feeding a medium;

(c) means for transferring the toner image to the medium fed by said feeding means at an intermediate position along a medium feed path;

(d) a pressure roller which is formed so as to move upward and downward; and (e) a heat roller fixing unit, in which the pressure roller and a heat roller are arranged in opposition to each other, and said medium is passed between said rollers to fix said image formed thereon, said heat roller fixing unit including (i) a heat roller unit in which said heat roller is supported, (ii) a main frame having guide rails for said heat roller unit, wherein said heat roller unit can be separately inserted into and withdrawn from said main frame along said guide rails when said pressure roller is moved downward, and (iii) a driving portion formed by a gear construction having gear portions to be engaged with a driving gear provided in said main frame, wherein said driving portion is engaged with said driving gear provided in said main frame when said heat roller unit is inserted into said main frame, wherein said pressure roller is mounted on a frame on which said feeding means and said transferring means are mounted, said pressure roller being moved upward and downward in accordance with the movement of said frame, and wherein said pressure roller is supported by a member having a poor thermal transmission coefficient on said frame.

3. A printing apparatus according to claim 2, wherein said feeding means comprises feed rollers, and said transferring means is a discharger.

4. A printing apparatus according to claim 1, wherein said pressure roller is mounted on a frame on which said feeding means and said transferring means are mounted, and said pressure roller is moved upward and downward in accordance with the movement of said frame.

5. A printing apparatus, comprising:

(a) a main frame;

(b) means for forming a toner image;

(c) means for feeding a medium;

(d) means for transferring the toner image to the medium fed by said feeding means at an intermediate position along a medium feed path;

(e) a heat roller unit mounted for movement relative to the main frame via guide rails, containing a heat roller and arranged opposite to a pressure roller in the main frame, wherein said medium is passed between said rollers to fix said image formed thereon, wherein said pressure roller is mounted via positioning means for movement within the main frame between a first position abutting the heat roller and a second position spaced from the heat roller, and wherein, when the pressure roller is in the second position, said heat roller unit can be inserted into and withdrawn from said main frame along said guide rails, separate from the pressure roller.

6. The printing apparatus as recited in claim 5, further comprising:

(f) a lock mechanism, including (i) a lever connected to one end of a shaft, said lever having at a first end an operation bar engagable by an operator of the apparatus and at a second end gear means, (ii) a rotatable member having a gear portion engagable with the gear means, and a rotatable roller, wherein when the rotatable roller is rotated, the pressure roller can be connected to and disconnected from the heat roller.

7. The printing apparatus according to claim 5, wherein said pressure roller is mounted on a frame on which said feeding means and said transferring means are mounted, and said positioning means positions said pressure roller at said first position and at said second position by moving said frame relative to the heat roller unit.

8. The printing apparatus according to claim 7, wherein the positioning means, comprises:

(i) a lever connected to one end of a shaft, said lever having, at a first end, an operation bar engagable by an operator of the apparatus and, at a second end, gear means, and (ii) a rotatable member having a gear portion engagable with the gear means, and a rotatable roller, wherein when the rotatable roller is rotated, the pressure roller can be moved to the first to the second positions.

* * * * *

UNITED STATES PATENT AND TRADEMARK OFFICE

Certificate

Patent No. 4,791,448 Patented: Dec. 13, 1988

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Masato Kawashima Kawasaki, Japan.

Signed and Sealed this 18th Day of July, 1989

Abraham Hershkovitz
*Petitions Examiner*
*Office of the Deputy Assistant*
*Commissioner for Patents*

UNITED STATES PATENT AND TRADEMARK OFFICE

CERTIFICATE OF CORRECTION

PATENT NO. : 4,791,448

DATED : Dec. 13, 1988

INVENTOR(S) : KAWASHIMA et al.

It is certified that error appears in the above-identified patent and that said Letters Patent is hereby corrected as shown below:

ON THE TITLE PAGE:

Assistant Examiner: delete "Lav" and insert --Lau--.

Col. 10

Line 28, delete "nector" and insert --nectors--.
Line 62, delete "21" and insert --221--.

Signed and Sealed this

Second Day of January, 1990

*Attest:*

JEFFREY M. SAMUELS

*Attesting Officer*

*Acting Commissioner of Patents and Trademarks*